United States Patent [19]

Heisler

[11] Patent Number: 4,548,025

[45] Date of Patent: Oct. 22, 1985

[54] TRAY ERECTING APPARATUS WITH ADJUSTING CAPABILITY

[76] Inventor: Raymond A. Heisler, 224 Passaic Ave., Fairfield, N.J. 07007

[21] Appl. No.: 666,479

[22] Filed: Oct. 30, 1984

Related U.S. Application Data

[63] Continuation-in-part of Ser. No. 310,604, Oct. 9, 1981, abandoned.

[51] Int. Cl.[4] ..... B65B 11/08

[52] U.S. Cl. ..... 53/580; 53/207; 53/209

[58] Field of Search ..... 53/397, 462, 491, 207, 53/208, 209, 218, 580; 74/89.17; 271/171, 223; 493/177, 479

[56] References Cited

U.S. PATENT DOCUMENTS

| | | | |
|---|---|---|---|
| 3,504,478 | 4/1970 | Dieter | 53/209 X |
| 3,530,640 | 9/1970 | Hoffman | 53/209 X |
| 3,555,776 | 1/1971 | Nigrelli | 53/207 X |
| 3,832,822 | 9/1974 | Sherman | 53/207 X |
| 3,848,394 | 11/1974 | Heisler | 53/491 X |
| 3,964,239 | 6/1976 | Elford | 53/207 |
| 4,089,150 | 5/1978 | Heisler | 53/452 |

*Primary Examiner*—John Sipos

*Attorney, Agent, or Firm*—Ralph R. Roberts

[57] ABSTRACT

There are depicted, described and claimed an apparatus and method for receiving and transporting tray blanks of corrugated cardboard. Cutouts provide means for bending of flap portions of the blank which form the outer retaining walls or members. Asjustment is provided for the frame support and for the size of the tray as to its width, length and sidewall height. The tray blanks are advanced forwardly to and into a hopper where the lowermost tray blank is withdrawn from a stacked array by a plurality of vacuum cups carried by and on arms. The tray is erected on a reciprocably-moved table by apparatus whereat the back edge portion is brought to a normal position, then the partially erected tray is filled with containers brought by conveyors and said containers are inserted by pushers. The forward end of the tray is brought to a substantially vertical condition by Y-fingers. The rear inner side flaps are moved to a position against the containers by pivoted finger mechanism. This pivoted mechanism is actuated by a pneumatic cylinder which moves a block and the pivoted finger mechanism forwardly at a greater speed than the reciprocated table. The forward inner flaps of the tray blank are also turned inwardly by plows mounted to the frame. The outer flaps are lifted so as to close the sides of the tray and by hot-melt adhesive the ends are secured with pushers positioning and retaining the flaps until the adhesive is set.

19 Claims, 35 Drawing Figures

TRAY ERECTING APPARATUS WITH ADJUSTING CAPABILITY

CROSS-REFERENCE TO RELATED APPLICATION

This is a C-I-P Application of my application of and with the same title and filed Oct. 9, 1981 with Ser. No. 310,604. With the acceptance of this application and transfer of some of the sheets of drawings, the application Ser. No. 310,604 is expressly abandoned.

BACKGROUND OF THE INVENTION

1. Field of the Invention

With reference to the field of art as established in and by the U.S. Patent Office, the present invention is believed to be found in the Class entitled, "Package Making" (Class 53).

2. Description of the Prior Art

The apparatus directed toward tray making has been mainly that of and by manual methods. Automatic erection has been most often in the high-speed production of like trays of the same size and the filling has been of like size and shaped items, usually soft wares or drinks. Six-pack trays with or without a shrink wrap assist are well known and are produced in high speed and great volume. So far as is known, it is novel to provide apparatus for the erecting, filling and delivering trays and having an adjusting capability for easy and rapid change for a large range of sizes of the tray and product.

The present invention is directed toward the erecting of trays used to carry four or six one-gallon cans of paint and the like. This same tray-erecting mechanism can and is used for the assembling of smaller and/or larger cans or containers. Trays are also conventionally used with and for half-gallon and quart containers. Trays are designed to retain the lower portion of the containers by providing a bottom and four secured sides. These sides may be secured by staples, but adhesive is preferred since the tray is thus much more rigid and the possibility of cutting of a hand during emptying is greatly reduced.

Trays erected and filled manually not only require more manpower but also require more space. The manual erection of trays requires advance erection and storage which is often several times the floor area required for the automatic apparatus of this invention. The filling of the erected trays requires the hand operation of usually two or three attendants and the transporting to palletizing operations requires even more attendant attention. The apparatus as presented in this application is automatic and requires an attendant only to replenish the tray hopper and insure that jams do not occur or are freed in short order. The attendant is not intended to perform packaging and filling of trays. The adjusting of size for product change is, of course, performed by a trained attendant.

Trays, of course, contemplate the use of a flat sheet. There may or may not be cutouts in the tray blank providing grip assists for lifting the loaded tray. These tray blanks have cutouts to provide tabs that are folded to provide secured end walls. These tabs may be the length of nearly one-half of the end wall or may be of less length. Conventionally, the tray when erected has the side and end walls of substantially the same height. The tray blanks are of like construction and size for producing a given tray but the apparatus to be hereinafter disclosed may be easily and rapidly adjusted to accept and erect trays of different sizes to accommodate containers of different size or for packing of different quantities such as four or six.

SUMMARY OF THE INVENTION

This invention may be summarized, at least in part, with reference to its objects. It is an object of this invention to provide, and it does provide, tray erecting mechanism which receives tray blanks, erects and packs the trays around the containers brought thereto and delivers the filled and erected trays to conveying means for delivery to palletizing means and the like.

It is a further object of this invention to provide, and it does provide, tray blank delivery means, a vacuum suction means provided on a swinging arm, a partial erecting of the tray and then filling, folding the sides and ends of the tray and then gluing the tabs. This apparatus is adjustable to the extent that trays of varying size may be erected and filled by this apparatus.

In brief, this apparatus provides a tray blank storage and advancing mechanism which is adjustable to accept a given range of blanks. These blanks are drawn one-by-one from a storage chute by a plurality of swing arms, each of which have a suction cup device adapted to engage and withdraw the tray from the stack. The tray is grasped on the rear panel portion and drawn to a support surface where the tray is partly erected as to the rear panel. This partly erected tray is now loaded with the desired amount of containers.

After the placement of the containers the front panel is raised into position whereat the two rear side flaps are brought to the sides of the containers. The front side flaps are brought against the containers during a forward transfer of the tray. This turning is achieved by plow fingers. A hot melt adhesive applies the desired adhesive to the flaps. The tray is now advanced so as to bring the outer flap ends into place and engagement with the inner flaps and the adhesive applied thereto. A pressurized pusher urges the outer flap into adhesive setting condition after which the filled tray is advanced to palletizing operations.

The above simplistic description of the apparatus and its functions is not intended to overlook the adjustability of the apparatus. The apparatus is anticipated to be adjustable within certain limits. For example, the trays may have a width change of as much as fifteen to twenty percent. The filling means is made to suit the product—for example, round, square or oblong containers or cardboard boxes or packages which may be more than one tier high. The filling of the trays may be for four or six or more containers. The length of the tray may be increased more than twenty percent and may be as much as twice the smaller length. The disclosure, to be hereinafter more fully defined, shows two preferred methods of expanding or contracting the apparatus, but these are only preferred examples and do not preclude equivalents.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen a specific embodiment of a tray erecting apparatus and method with adjusting means as adopted for use in retaining a selected quantity of containers or cartons and showing a preferred means for adjustment and arrangement of operations. This specific embodiment has been chosen for the purposes of illustration and description as shown in the accompanying drawings wherein:

BRIEF DESCRIPTION OF THE DRAWINGS

FIG. 1G-2 represents a diagrammatic, isometric view of the filled and erected tray of FIG. 1G-1 in a slightly further forward condition, with the side flaps being slightly canted upwardly and with the rear finger mechanism moving away from the side flaps of the tray;

FIG. 1G-3 represents a diagrammatic, isometric view of a filled and erected tray of FIG. 1G-2 in a still further forward condition, with the side flaps now canted to an angle of about thirty degrees, the finger mechanism for turning the rear flap portions now removed;

FIG. 2 represents a plan view, partly diagrammatic, and showing the arrangement of several mechanisms used in the tray erecting and filling operation;

FIG. 3 represents an isometric, partly diagrammatic, assembly view of the tray erecting, filling and delivery apparatus of this invention;

In the following description and in the claims, various details are identified by specific names for convenience. These names are intended to be generic in their application. Corresponding reference characters refer to like members throughout the several figures of the drawings.

TRAY ERECTING AND FILLING AS IN FIGS. 1A THROUGH 1J

Referring next and now to the drawings, there is shown in FIGS. 1A through 1J, a diagrammatic representation of the steps that are provided in the tray erecting and filling of said trays. In this showing, these FIGS. are more or less diagrammatic and do not show or suggest the adjusting mechanism provided and exemplified in later FIGS.

Figure 1A:
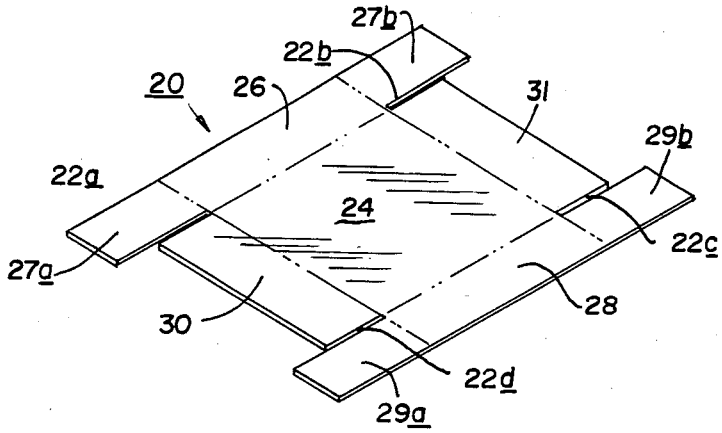
FIG. 1A represents a diagrammatic, isometric view of a tray blank or corrugated cardboard which is cut and scored in the usual manner.

In FIG. 1A there is depicted a tray blank, usually of cardboard, and generally identified as 20. The blank is shown with four cutouts a 22*a, b, c* and *d* extending toward the central portion 24. A left or rear side edge portion 26 has two flap portions 27*a* and 27*b* and the front or right side edge 28 has similarly formed flap portions 29*a* and 29*b*. Between these sides 26 and 28 and outside of the score lines are outside flap portions 30 and 31. Although the central portion 24 is shown as nearly square, the selection of the tray blank and the flaps and score portions is a matter of choice commensurate with packaging and retaining the product. The tray is usually for an even number of containers, each of which is filled with a product, usually secured by an attached cover or lid. The trays may be loaded with cardboard, plastic or like cartons arrayed in a single layer or may be in multilayers. The apparatus is easily adjusted to accommodate the different products to be packaged in a tray which is sized to suit the particular requirement as to size and height.

Figure 1J:
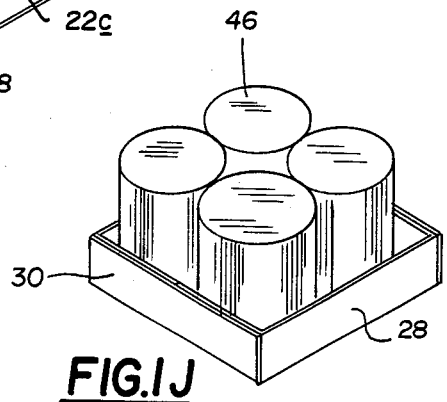
FIG. 1J represents a diagrammatic, isometric view of the erected and filled tray ready for or as delivered to a palletizing means.
Figure 1B:
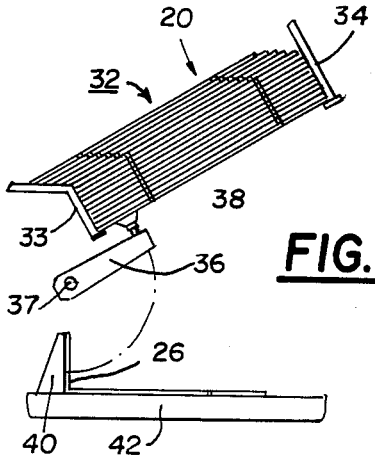
FIG. 1B represents a diagrammatic, side view of the hopper of tray blanks with the lower blank moved downwardly to an erecting condition.

FIG. 1B there is shown tray blank 20 which is carried in a stacked array 32 by a hopper or chute having a lower guide support 33 and an outer stop and retainer 34. Pivoted arms 36 are carried on a reciprocally actuated shaft 37 and each arm carries a suction cup end member 38. Each of these cups is connected to a source of vacuum and when swung into the position shown grasp the lowermost tray blank at the end flap portion 26. The downwardly movement of these arms in an arc brings the tray into a partially erected position as carried and provided by stop 40 and table 42. As later shown, there are two stops 40 each of which is carried with a reciprocable table 42. One stop is carried on each of the two tables. These tables and stops are moved in and out to accommodate the width of the tray to be erected.

Figure 1C:
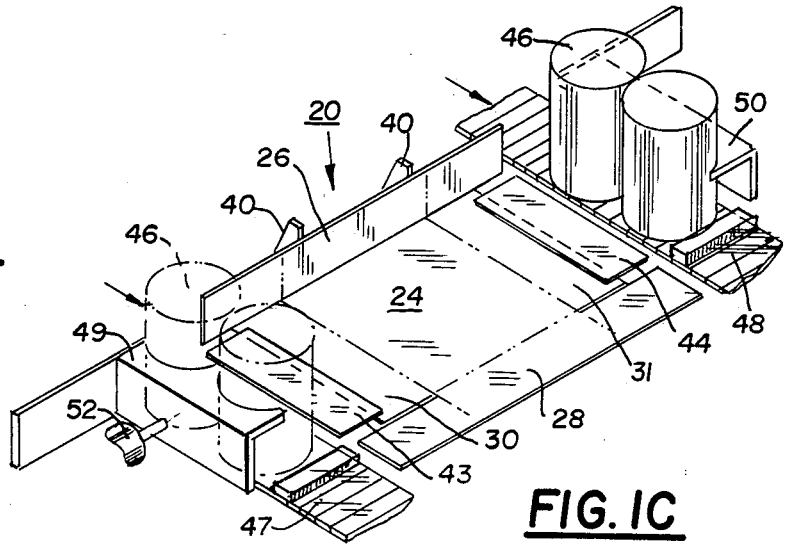
FIG. 1C represents a diagrammatic, isometric view showing the partially erected tray and the containers as carried by plate conveyors to an inserting position and condition.

In FIG. 1C the partially erected tray 20 is shown with far side edge portion 26 in a vertical condition as supported by stops 40. Two pivoted supports 43 and 44 are disposed so that one is on opposite sides of the tray blank 20 and are disposed above the side flap portions 30 and 31 respectively. These pivoting supports not only prevent the unwanted upward movement of the side flap ends 30 and 31, but provide a bridge support for the sliding movement of containers or boxes 46 as they are advanced from delivery conveyors 47 and 48. In later FIGS. (FIG. 19A) the pivoted supports are shown for use with round metal containers 46 in which apparatus there is no need or requirement for side guide means. If the trays are to be used for boxes of material (some of which weigh very little), the guiding means (FIG. 19B) may include pivoted side guides shown in this later discussed FIG. The containers, if of metal, are engaged and guided by and during their inward movement with like pusher members 49 and 50. These pusher members are disposed on opposite sides of the erected tray and are moved in a timed relationship by pneumatic cylinders 52. Only the near cylinder is depicted and then only the forward portion is shown.

The partially erected tray 20 is moved forwardly by stops 40 and the side flaps 30 and 31 are engaged by the pivoted supports 43 and 44 as diagrammatically represented. As and when the desired forward movement has been achieved, the two containers 46 on each of the delivery conveyors 47 and 48 are stopped by means to be more fully described hereinafter. The pusher members 49 and 50 engage and cup the sides of the containers 46 and urge them to the nested condition on the central portion 24 of the tray. Although only four containers 46 are shown, this is not to imply that more or fewer containers may not be packed in an erected tray. The containers 46 may or may not have applied bails. When and where the trays are to be used for packaging cartons, the forward edge portion 28 is erected, but if the tray is used for round containers it is to be noted that the near edge portion 28 has not been moved from its plane during the filling shown in FIG. 1C.

Figure 1D:
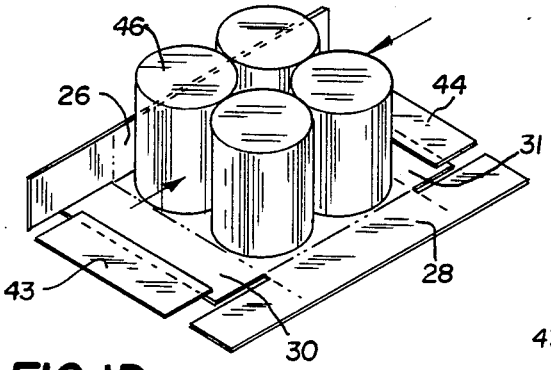
FIG. 1D represents a diagrammatic, isometric view of the tray and containers of FIG. 1C, but with the containers moved into a nested condition on the tray blank.

In FIG. 1D the containers 46 have now been pushed into position on the central portion 24 of the tray as indicated by the arrows. The side flaps 30 and 31 are still retained by pivoted supports 43 and 44 with the erected rear left side portion 26 and forward right side portion 28 as in FIG. 1C.

Figure 1E:
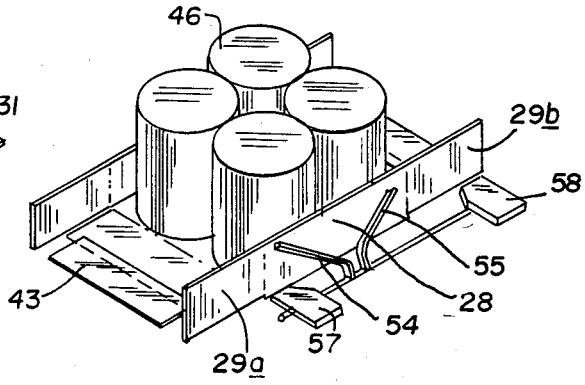
FIG. 1E represents a diagrammatic, isometric view of the partially erected and filled tray of FIG. 1D and with the forward flap or side wall in an erected condition.

In FIG. 1E the tray of FIG. 1D is shown, but the forward right side portion 28 has been raised to an erect or vertical position and condition by Y-finger portions or members 54 and 55. These Y-finger members are moved by a reciprocating apparatus to be more fully shown and described hereinafter. Diagrammatically shown are falp turning plows 57 and 58 disposed to turn forward flap portions 29*a* and 29*b* inwardly as the tray is advanced forwardly. When the tray is moved forwardly to bring plows 57 and 58 in engagement with portions 29*a* and 29*b*, the Y-finger portions are moved to a non-engaging condition. The Y-fingers are carried by mechanism on a center member and are described in detail in FIGS. 16 and 17. These fingers are adjusted to accommodate the tray to be erected.

Figures 1, 1G, 2, 3:
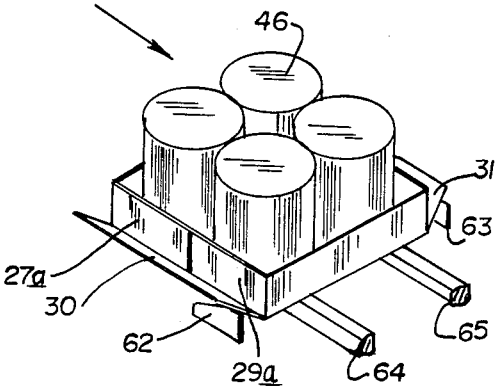
Figures 1, 1G, 2:
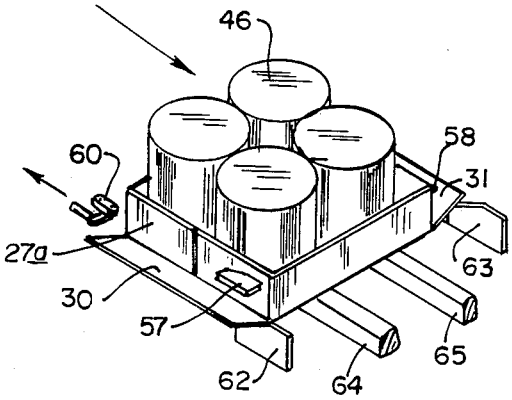
Figure 1F:
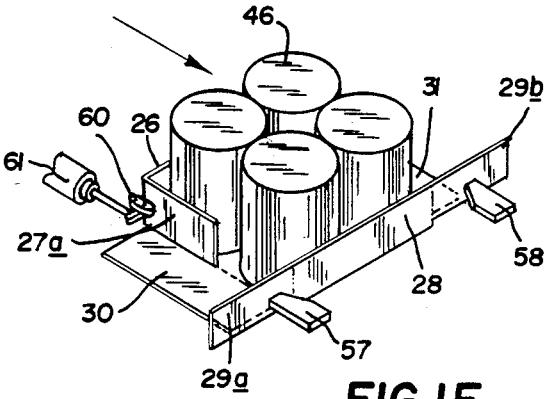
FIG. 1F represents a diagrammatic, isometric view with the rear side flap portions tucked inwardly to a folded condition.
Figures 1, 1G:
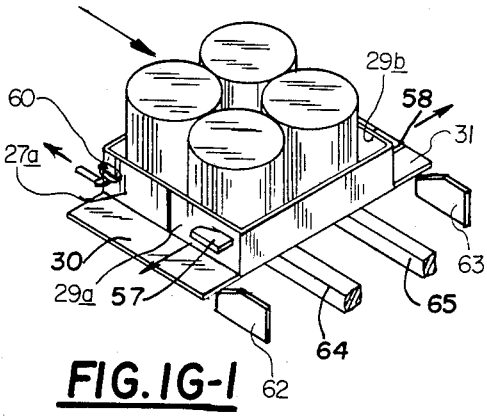
FIG. 1G-1 represents a diagrammatic, isometric view of the filled and erected tray of FIG. 1F, with the forward side flap portions now in a folded condition and with the mechanism for rear side flap tucking beginning to be withdrawn and the flap guides just ready to engage the side flaps.

In FIG. 1F the tray of FIG. 1E is depicted with the pivoted supports 43 and 44 removed. The flap portions 27*a* and 27*b* are moved forwardly to a substantially right-angle position by finger mechanism 60 and cylinder 61 to be more fully described hereinafter. Containers 46 are depicted and are in place, and the flap turning plows 57 and 58 have engaged the front flaps 29*a* and 29*b* sufficiently to retain forward near side portion 28 in a vertical condition. The Y-members of FIG. 1E have been moved to a nonengaging condition and position and are thus not shown.

In FIGS. 1G -1, 2 and 3, the tray of FIG. 1F has been carried forwardly by the reciprocating table portions 42 (described in prior FIGS.) These table portions are not shown in these views, but are shown and more fully described in conjunction with FIGS. 18A through 18D. In FIG. 1G -1, the flap turning plows 57 and 58 have caused the front flap portions 29*a* and 29*b* (not seen) to be brought against the depicted containers 46. In this view, flap guides 62 and 63 are in way of side flaps 30 and 31 to start and eventually cant or lift these side flaps upward to about thrity degrees. The finger mechanism 60, having reached its forward limit, is beginning to move rearwardly and the flap turning plows 57 and 58 are movable outwardly as indicated by the arrows. The table portions 42 are tapered forwardly so the filled tray may be slid onto support slides 64 and 65 with little or no dislodgement of the tray contents.

Figure 1H:
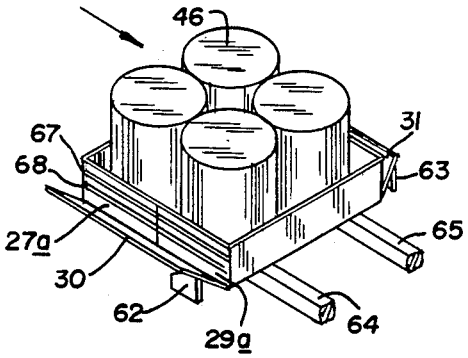
FIG. 1H represents a diagrammatic, isometric view of the filled tray of FIG. 1G-3 and with hot-melt adhesive disposed on the inside flaps.
Figure 1I:
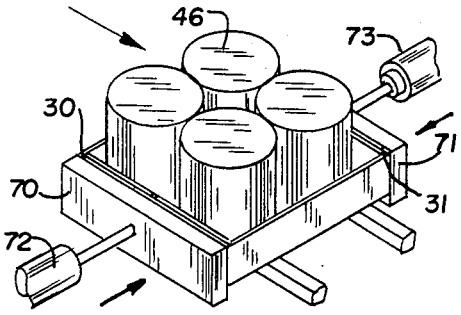
FIG. 1I represents a diagrammatic, isometric view of the erected and filled tray of FIG. 1H and with the inner and outer side flaps urged into adhesive-setting condition by pressure pad members.
Figure 2:
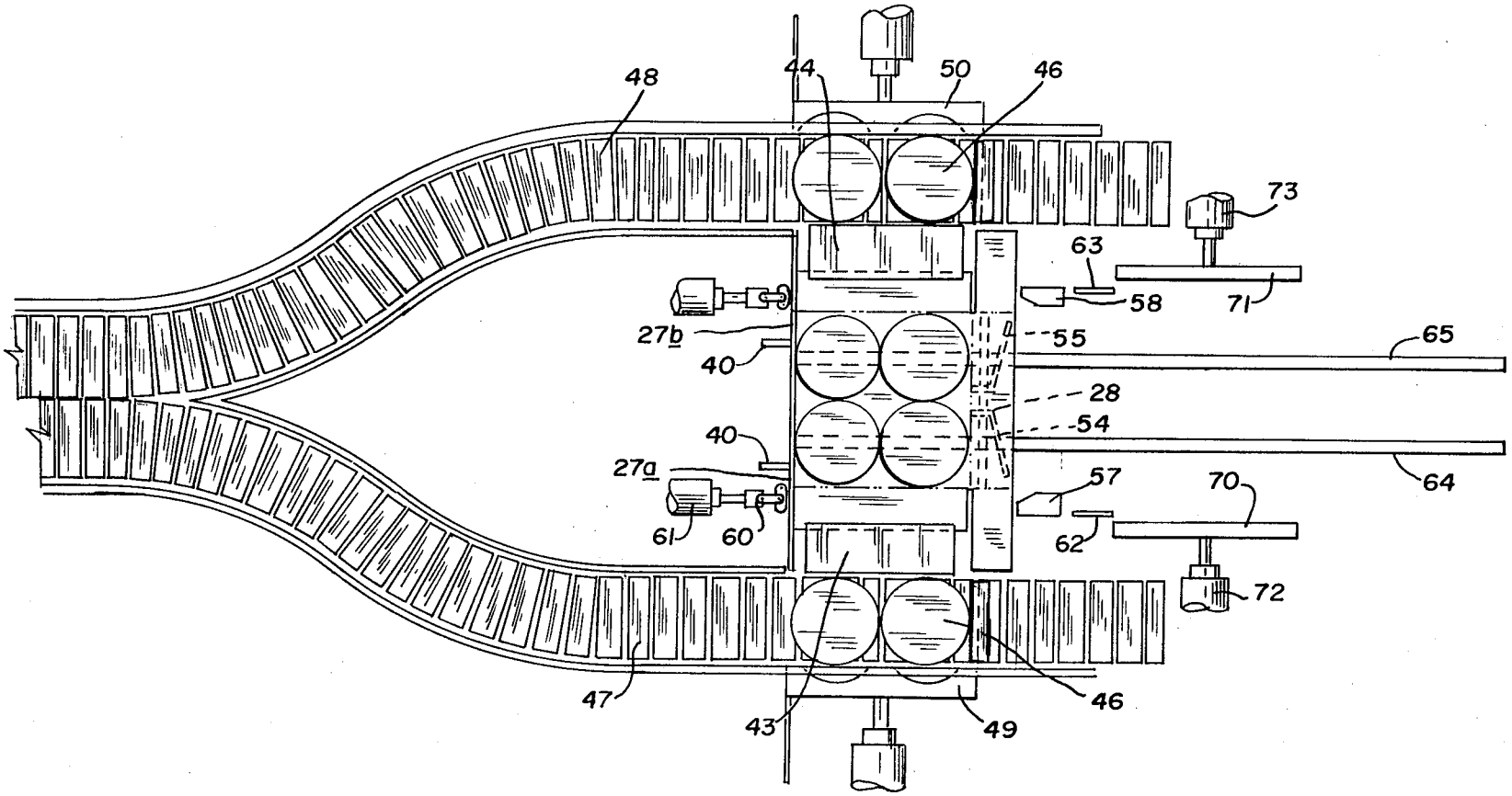
Figure 3:
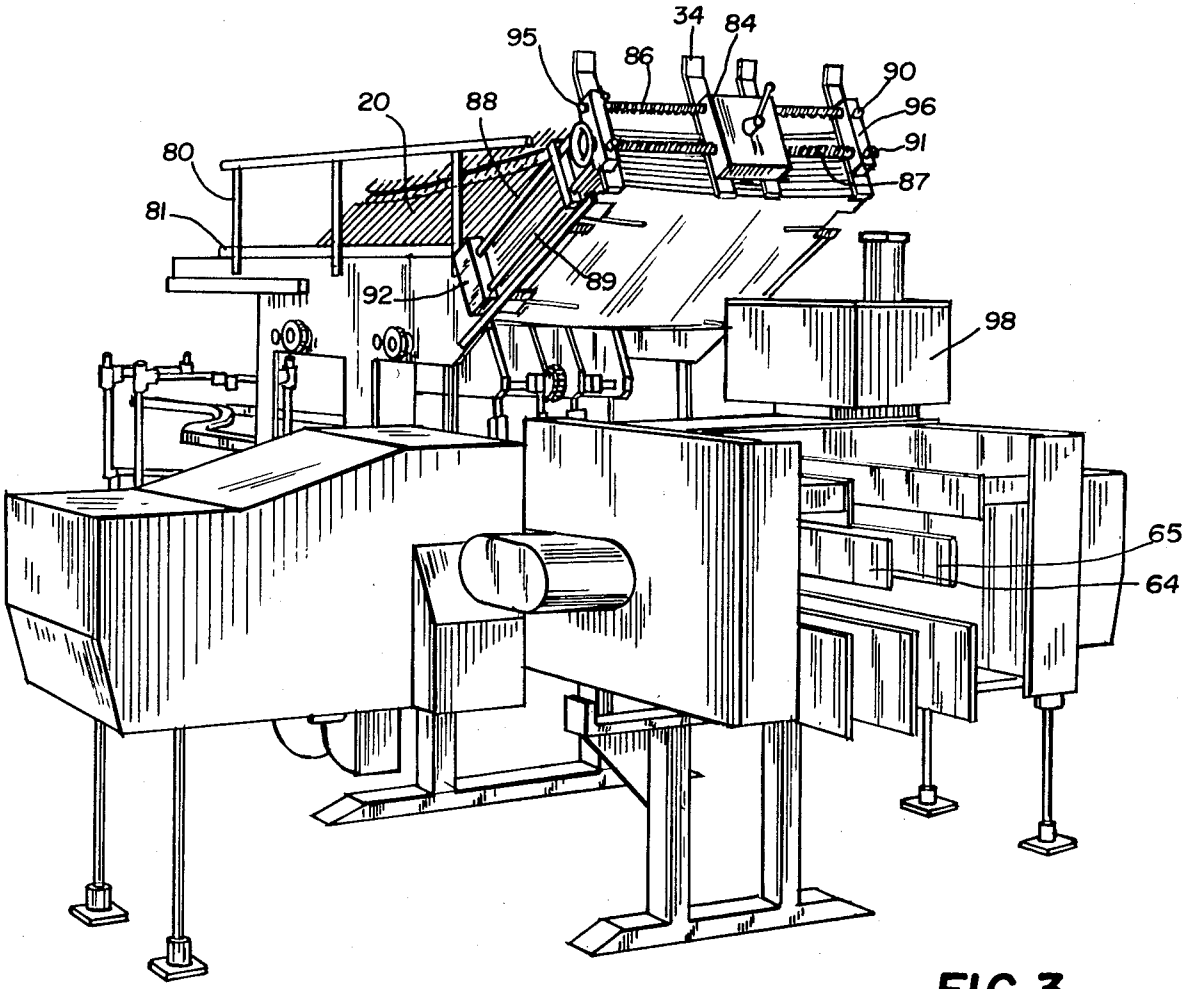

In FIG. 1H the tray of FIG. 1G has been brought to a glue station whereat hot melt adhesive from mechanism not shown deposits parallel strips 67 and 68 onto inturned flap portions 22*a* and 29*a*. The side flap 30 is sufficiently open by means of flap guides 62 so that adhesive may be delivered as the tray is moved forwardly. The opposite side having flap portions 27*b* and 29*b* and flap 31 is also deposited with hot melt adhesive.

In FIG. I the filled and erected tray has been advanced to a flap compressing station. Pushers 70 and 71 are moved by pneumatic or hydraulic cylinders 72 and 73 into a flap securing condition and position. The pressure in the cylinders 72 and 73 is made sufficient to push the side flaps 30 and 31 into a tight seating condition against flap portions 27*a* and 29*a* and to 27*b* and 29*b*. Containers 46 are now contained in a tray of given size and height.

In FIG. 1J the fully erected tray and containers 46 are shown ready for transfer to a palletizing operation. The flaps and sides are now secured, as by adhesive, and the tray erecting is complete. The adjustability of the apparatus, more fully described hereinafter, contemplates high-speed automatic operation as is needed in volume operation.

The diagrammatic illustration of the apparatus and steps in the erecting, filling and palletizing operation has been shown and described in conjunction with round containers, but this tray may be filled with square, rectangular, metal, plastic, or combinations of containers. The tray size as to length, width and height is merely a matter of selection. Although adjustability of the apparatus is contemplated, once set up for established conditions the run is contemplated to be for a few days or weeks. Adjustability, although contemplated, is not to be confused with rapid change since production runs are usual. The adjustability provided is so that redesign or rebuilding of the apparatus is not mandatory.

The several guards and apparatus employed to achieve high-speed erection, transport and the various operations in later FIGS. have not been deleted from the operations described above, but the brief diagrammatic step-by-step showing has been made to illustrate the sequence of operations for the tray erecting, filling and delivery of the preferred apparatus.

CONTAINER DELIVERY AND INSERTING STATION

In FIG. 2 is diagrammatically shown a plan view of the apparatus for erecting the trays, inserting the containers and delivering the completed trays. As shown, the containers 46 are advanced on two plate-type delivery conveyors 47 and 48 until these containers arrive at the inserting position of FIG. 1C. Hereinafter to be shown in detail are stops that not only prevent further forward progress, but also detect the presence of a desired quantity of containers. As shown, four containers (two from each side) are deposited simultaneously on a partially erected tray. Pusher members 49 and 50 are shown with arcuate contours for nesting round containers. The partial arcuate cutouts are adapted to nest and move the containers 46 forwardly or inwardly in a straight line without spinning when passing over sliding supports 43 and 44.

There are two stops, each pivotally carried by a table portion 42. These stops 40 are fragmentarily shown and are reciprocated rearwardly after flap portions 27*a* and 27*b* have been bent forwardly as in FIG. 1F. This mechanism is pneumatically actuated with cylinder 61 shown in this FIG. and is duplicated with associated finger mechanism 60 to turn flap 27*b*. The Y-fingers 54 and 55 shown in FIG. 1E are represented in dotted outline and are forward near side 28. These Y-fingers are pneumatically actuated and are carried on a center member as shown in more detail in FIGS. 16 and 17. The flap turning plows 57 and 58 which are moved in and out are shown without associated support structure. The flap guides 62 and 63 are also shown without associated support means. The flap pushers 70 and 71 are shown with cylinder actuating mechanism 72 and 73 respectively. Support slides 64 and 65 are shown as two in number, but may be and often are greater in number and are positioned to fully support the load of the several containers in the tray as and when erected and when particularly advanced to palletizing. The positioning and disposition of the hot-melt applicators has not been shown in this FIG.

DESCRIPTION OF THE APPARATUS AS IN FIG. 3

Figure 4:
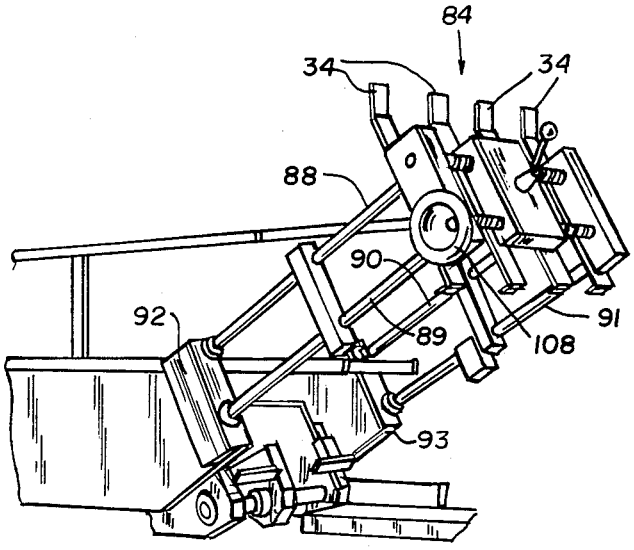
FIG. 4 represents a fragmentary, isometric view of the chute and some of the associated apparatus for removing the tray blank from the chute.
Figure 7:
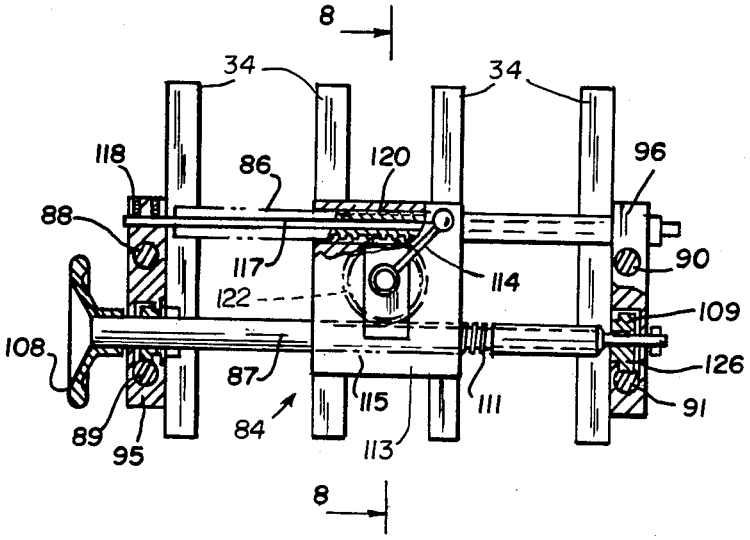
FIG. 7 represents a partly fragmentary and diagrammatic front view showing some sectional view portions and the width adjusting and locking apparatus for the tray blank chute.
Figure 8:
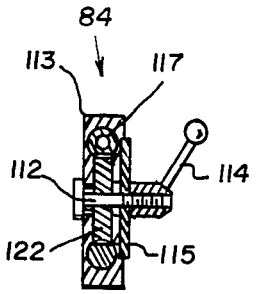
FIG. 8 represents a sectional view taken on the line 8—8 of FIG. 7 and looking in the direction of the arrows.
Figure 9:
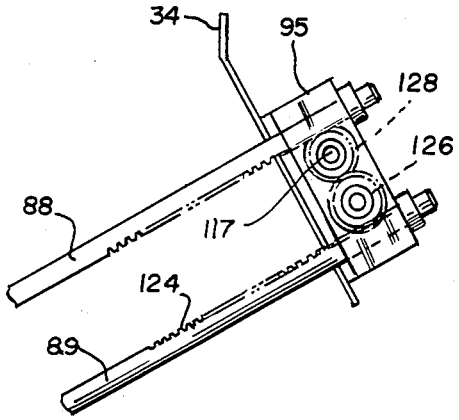
FIG. 9 represents a side view, partly fragmentary and diagrammatic, and showing the front stop and means for moving this stop by a hand wheel.

In FIG. 3 the tray erecting apparatus is depicted in an assembled condition and showing the guards used and useful to protect an operator or observer from accidental entanglement with the operating and moving components of the mechanism. The tray blanks 20 are disposed in a forwardly slope attached in a chute having sides and bottom members 80 and 81. At the delivery end of said chute is mounted the lower guide support 33 as seen in FIG. 1B. Stops 34 are plural in number and are adjustable so as to accommodate the selected width of the tray blank 20. These stops 34 are carried on a block 84 which maintains a central position during rotation of threaded shafts 86 and 87. The head end of the chute is adjusted for the length of the carton. This head end of the chute includes an assembly carried by and with shafts 88, 89, 90 and 91 which are carried by near support member 92 and a like member on the far side, which is not seen in this view but is shown in FIG. 4 and identified in that FIG. as 93. These shafts are attached to upper support members 95 and 96. A stop 34 is fixedly attached to each upper support member 95 and 96 and is moved in and out with the upper support member. The operation of the chute and its adjustability is described hereinafter in greater detail and in FIGS. 7, 8 and 9.

A hot-melt glue supply 98 is shown as mounted above the tray erecting and filling apparatus, but the nozzle or nozzles and the conduits used therewith are not identified as these nozzles are commercial and are selected, positioned and supplied as a matter of preference. Support legs and framework as well as the sheet metal guards are also a matter of selection and preference. Pressurized air and electrical power are conventional and are connected and used in the normal manner and the usual performance is made to suit a particular installation. Conventionally, the guards are of sheet metal and the legs and other support means are pipe and fabricated steel. Adjustment in the height of the operational apparatus is made to suit the operations to which and from which the containers are delivered and the filled trays are further prepared for shipment.

CARTON ESCAPEMENT AND ADJUSTMENT AS IN FIGS. 4, 5 AND 6

Figure 5:
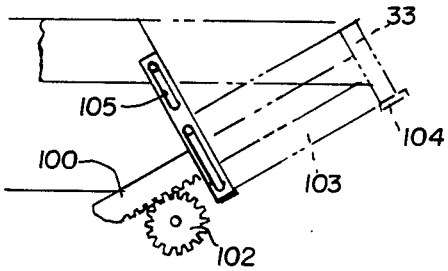
FIG. 5 represents a fragmentary side view, partly diagrammatic, of the adjustable chute of FIG. 4 and showing in particular the means for size adjustment.
Figure 6:
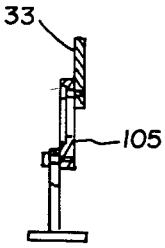
FIG. 6 represents a fragmentary sectional side view, partly diagrammatic and showing the chute side plates and their interleaving arrangement, permitting the chute to be adjusted to accommodate the length of the flat tray blanks carried therein.

Referring now to FIGS. 4, 5 and 6, there are shown fragmentary views of the means for adjustably accommodating the tray blanks and their placement and delivery in the chute. At this point mention of the desired propulsive and advancing means for carrying the tray blanks to the chute is made. The tray blanks are carried forwardly by a walking beam-type apparatus as seen in Applicants' U.S. Pat. No. 4,072,090. This walking beam concept insures that the advanced tray blanks 20 are always present in the chute for withdrawal therefrom. When a surplus of blanks is advanced from the supply to the chute, said chute is not overfilled since any oversupply of blanks to the chute, as in U.S. Pat. No. 4,072,090, causes delivery of the tray blanks to stall. This supply beam and the control thereof as specified in the U.S. Pat. No. 4,072,090 to the extent applicable is incorporated by reference in this application.

The fragmentary isometric view of FIG. 4 shows the adjustable chute in which the tray blanks 20 are delivered. From this chute the now angled tray blanks are withdrawn one-by-one by suction cups 38 carried by arms 36. (FIG. 1B) Since the tray blanks vary in both width and length the dimensions of the chute are changed to accommodate this size change of the tray.

As seen in FIG. 5, an adjustment means is shown in which the guide support 33 is shown as moved by a rack 100 and pinion 102 which in turn moves slide member 103 and attached lower shelf 104 to the desired position. Filler strips 105 are slotted members attached at their upper ends or edges to the rack member 100. As the slide member 103 is moved rightwardly or outwardly the lower guide support 33 and the attached lower shelf 104 moves to the right and upward as positioned by rack and pinion 100 and 102. The slotted filler strips 105 accommodate and provide a smooth side stop and support for the space between stop 33 and the slide 103. This filling in of the side chute prevents the tray blank 20 from being accidently misaligned in the chute.

FIG. 6 fragmentarily shows the typical construction of the side members of the chute and the simple construction enabling a rapid adjustment of the lower stop 104 as it provides the inner and lower stop for the tray blanks 20.

WIDTH ADJUSTMENT OF THE CHUTE AS IN FIGS. 7, 8 AND 9

The tray blanks are accommodated in their width by adjusting and positioning the sides in and out to retain and guide these blanks 20 as they are carried forwardly. Shafts 86 and 87 are transverse of the forward movement of the blanks 20 and are carried by shafts 88, 89, 90 and 91. As shown, shaft 87 (lower) extends leftwardly of the upwardly support member 95 and on its leftwardly extending end is mounted a handwheel 108. The other end of this shaft is reduced in diameter and carries an attached spur gear 126.

Shaft 87 (lower), although formed with threads 111, does not rotate shaft 112 which is a short shaft carried by a back member 113 portion of the block 84. A nut means 114 is rotated inwardly or outwardly to tighten or loosen plate 115 which provides a clamp means. This plate 115 is also carried by and on the shaft 112. The back member portion 113 also is formed with upper and lower passageways which provide upper and lower guide and retention means in this block portion for shafts 86 and 87.

Width adjustment for control of the tray blank is made with the moving of the chute and walking beam apparatus. The outer plate portion 115 is first loosened by the nut 114. The operator then moves the chute sides after which the nut is again tightened. As shown, the upper shaft includes an inner shaft portion 117 which is secured at its left end by set screws 118. The right end of this inner shaft portion is carried in the block 96. The outer shaft portion 86 is really tubular and may be freely rotatable on said inner shaft and has threads 120 formed thereon. Threads 111 and 120 are really annular grooves as they have no lead but they engage a spur gear 122 carried on shaft 112. The moving of the sides in and out while and when nut 114 is loosened allows the gear 122 to rotate and retain parallelism of the sides of the chute. Retightening of the nut 114 locks the shafts 86 and 87. It is to be noted that the right upper support block 96 has a slidable passageway for the outer shaft portion 86.

The shafts 88, 89, 90 and 91 have like rack portions or teeth 124 formed on each shaft. These teeth are disposed inwardly and the shaft is slidable in the passageway in each block. The handwheel 108 carried in the left end of shaft 87 rotates this shaft and like spur gears 126 which are secured to this shaft are carried in formed bores or recesses in blocks 95 and 96. These spur gears 126 are in mesh with like spur gears 128 (as seen in FIG. 90) carried in recesses formed in the blocks. These gears 128 are secured to the inner shaft portion 117. The lower spur gears 126 are also in mesh with the rack teeth 124 formed on the rods. The rotation of handwheel 108 causes a like rotation of the spur gears 126 which is transmitted to the in-mesh spur gear 128 and the cylindrical rack teeth 124 on the rods. Rotation of this handwheel 108 therefore causes the upper support blocks 95 and 96 to move up and down the rods at a like speed and for a like distance. In this manner the upper and outer flat stops 34 are positioned as desired.

USE AND OPERATION

As depicted, the rotation of handwheel 108 causes the upper support blocks 95 and 96 to be moved up and down the rods or shafts 88, 89, 90 and 91 a selected distance or amount. Stops 34 and like intermediate stops, when and where desired and required, are moved up and down a like distance. The lower transverse shaft 87 has a rack configuration made as a series of cylindrical grooves. The upper shaft 86 as a sleeve member has a toothed portion. This may be grooves as in the lower shaft or may be rack portions similar to those formed in the shafts 88 through 91. With the nut 114 loosened the near and far sides of the chute are moved in and and gear 122 rotates to insure a self-centering of the plate member 115 on the shaft 87. The upper shaft 86 remains in the desired orientation only when a toothed rack is formed thereon as the meshed gear 122 prevents rotation of this outer sleeve and shaft 86. The inner shaft 117 is supported at both its ends and is non-rotatable as the left end is retained by set screws 118. As the sides and blocks are moved in and out to accommodate the tray blank width, the side plate assemblies and upper and lower support blocks 92 and 93 are likewise moved. The side adjustment when completed is locked against further movement.

It is to be noted that at least in certain apparatus, the adjustment of the upper and outer end of the chute and upper support blocks 95 and 96 may be achieved with any by rack teeth 124 formed in only the lower rods. Spur gears 126 are driven by the rotation of shaft 86 and by the hand wheel 108. As the hand wheel is rotated the spur gears 126 engage the rack teeth 124 on the rods and move the blocks 95 and 96 up and down. The smooth upper rods slide in the passageways formed in the blocks 95 and 96. The spur gears 126 are usually moved only when the plate clamp 115 is loosened and the hand wheel 108 is rotated. If desired, the upper shaft may have the rack teeth formed thereon and the hand wheel mounted on the upper shaft.

WIDTH ADJUSTMENT AS IN FIGS. 10 THROUGH 13

Figure 10:
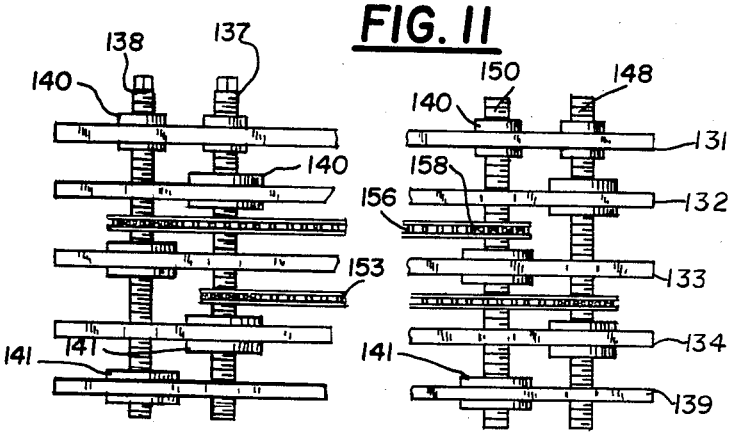
FIG. 10 represents a plan view, quite fragmentary and diagrammatic, and showing a means for size adjustment or movement of the adjustable frame support of the apparatus.

Referring next to the drawings and in particular to FIGS. 10 through 13, there is depicted adjusting apparatus which discloses means for moving the main frame and the associated components in or out to accommodate the erected tray and the blank used therewith. The main frame may have five support plates identified as 131, 132, 133, 134 and 135. These plates are moved in and out from the central plate member 133 by turning only two transverse threaded shafts 137 and 138. The center plate member 133 in FIG. 10 is adapted to carry shafts 137 and 138 which are formed with right and left hand threads. These threads engage and are carried in appropriately threaded right and left hand nuts 140 and 141. As shown, these nuts are mounted in intermediate plates 132 and 134. A roller chain 143 extends between and around and rotates sprockets 145 and 146 (FIG. 11) mounted respectively on shafts 137 and 148. The extending end of shaft 137 or shaft 148 has a shaped end for the removable turning thereof by a wrench or handle. Conventionally, this shaped end is a square but any appropriate shape may be provided. The shaft 137 is rotated either clockwise or counterclockwise. As the shaft 137 is rotated the sprocket 145 is also rotated and the chain 143 in engagement therewith is moved accordingly to cause the sprocket 146 to be rotated a like amount. The rotation of the shafts and the associated sprockets cause the engaged nuts 140 and 141 in the intermediate plates 132 and 134 to move in and out to the desired position.

Also shown in FIG. 10 is a threaded shaft 150 which is to the right of shaft 137. A bearing and retainer 152 or collars are mounted on this shaft and are adapted to maintain shaft 150 in a rotatable condition in central plate 133. The threaded shaft 150 also has right and left hand threads. The intermediate plates 132 and 134 have clearance holes or passageways so that the turning of shaft 150 does not affect the positioning of these plates. Right and left hand nuts 140 and 141 are similar to or are identical to those used on shafts 137 and 138. These nuts are secured to the outer plates 131 and 135 and move these plates when shaft 150 is rotated. Similar collars or a bearing and retainer are also mounted on shaft 138 seen in FIG. 11. A roller chain 156 is mounted on sprocket 158 mounted on shaft 150. The extending end of this shaft also is formed with a hex or square so that this shaft may be turned to cause the outer plates to be moved in and out toward and away from each other.

Shaft 150 and the roller chain 156 when moved to cause the outer plates to be moved also moves the shaft 154 which has a sprocket engaged by the roller chain 156 so that the outer plates may be moved in concert. The rotation of shaft 150 results in a like rotation of shaft 154. Normally the crank or wrench is removed from the ends of the shafts except during adjustment.

Figure 12:
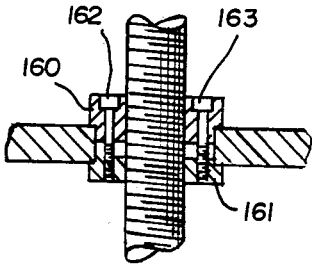
FIG. 12 represents, in an enlarged scale, a typical sectional view of a threaded shaft and the nut which is adjusted and then fixed in position on a plate member.
Figure 11:
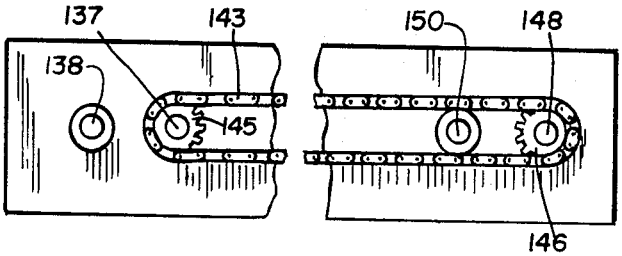
FIG. 11 represents a side view, partly in section, and taken on the line 11—11 of FIG. 10 and looking in the direction of the arrows.

In FIG. 12 the enlarged sectional view depicts an intermediate or outer plate 131, 132, 134 or 135, which shows a threaded shaft in an assembly which includes a threaded nut portion 160 which is shouldered to seat in a hole formed in said plate. A tightening disk or plate 161 draws the threaded nut portion 160 into retaining condition. Cap screws 162 and 163 pass through countersunk holes 164 into threaded holes 165 formed in disk 161. When tightened in position screws 162 and 163 retain the nut portion 160 in fixed condition. Before tightening the rotating of the shaft and nut is made to allow the plate associated therewith to be precisely positioned. The companion nut with the opposite threads is mounted on said shaft and tightened to position a like plate a like distance from the center plate 133. It is to be noted that with the cap screws 162 and 163 loosened, the nut portion 160 is or may be rotated to a desired position before clamping. The positioning of each nut assembly along the threaded shaft may be made at any time to establish or reestablish parallelism of the plates.

Figure 13:
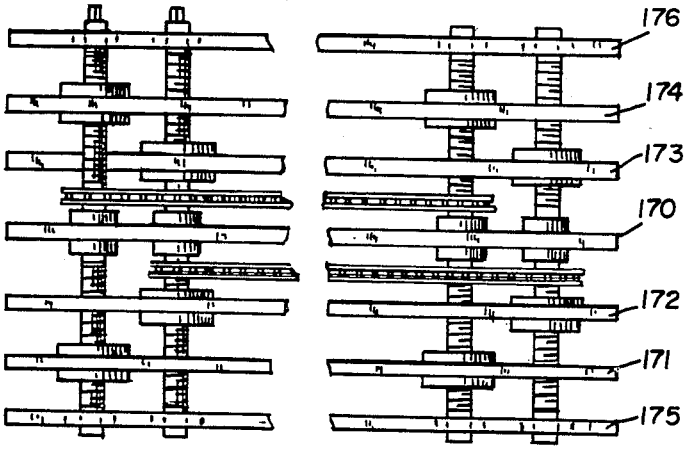
FIG. 13 represents a plan view, very much like that of FIG. 10, but with more plate members of the frame apparatus.

In FIG. 13 is depicted an assembly or support employing seven plate members. This embodiment depicts the outer plates as being fixed with the inner plates adjustable. Central plate 170 has intermediate plates 171, 172, 173 and 174 with outer plates 175 and 176 not moved. Roller chain and sprockets are like that in FIG. 10 and the collars next to central plate 170 and the nut assembly 160 of FIG. 12 are employed to permit adjustment.

Not shown but contemplated is an arrangmment whereby an outer plate is made as the fixed plate with the threaded shafts and nuts arranged for controlled in and out movement by roller chains and sprockets. The arrangement of the plates and controlled movement is a matter of choice. A near or a far plate may be provided as a fixed plate. The support of the shaft at the fixed plate may be a smooth bearing that provides not only a longitudinal stop but also provides rotational capability. As few as three supports or plates may be used or any number in excess of this number may be provided according to the desires of the maker and user of the tray erecting apparatus.

Figure 15:
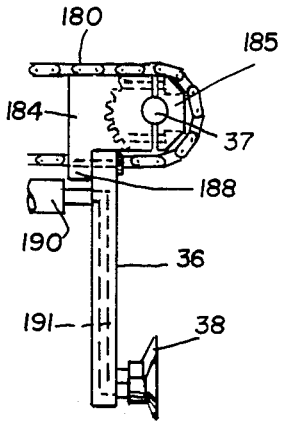
FIG. 15 represents a side view, partly fragmentary, and taken on the line 15—15 of FIG. 14 and looking in the direction of the arrows.
Figure 14:
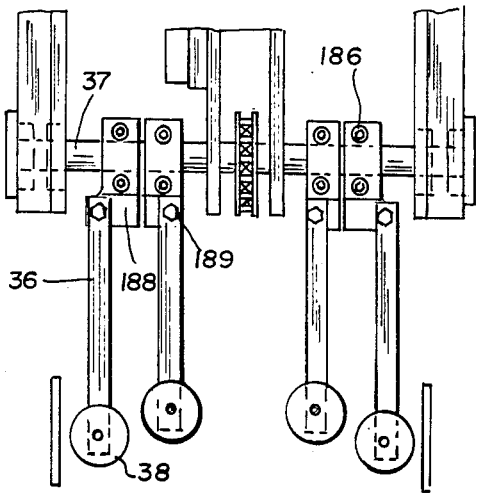
FIG. 14 represents a plan view, partly fragmentary and diagrammatic, of the vacuum arms and cups and removal of the arms, as provided in the apparatus, and actuation for removal and erection of the tray blank.

VACUUM APPARATUS AND CUPS OF FIGS. 14 and 15

In FIGS. 14 and 15 the pivoted arms 36 of FIG. 1B move a plurality of suction cups 38 into engagement with the far side edge portion 26 of tray blank 20. As illustrated, there are four cups, each of which is carried by an arm 36. Conventionally, these cups have the outer pair aligned and the inner pair also aligned but at a different distance from the axis of the shaft 37. As noted, shaft 37 is reciprocably rotated and preferably the movement is achieved by a roller chain 180 which is mounted on and drives a sprocket 182 also mounted on shaft 37. The movement and extent of movement of chain 180 is adjusted to suit the tray blank used. The arms 36 are shortened or lengthened to accommodate the far side edge portion 26 of the tray. The arm is removably mounted to a mounting base block 184 which includes a half bore for shaft 37. The other half of the securing means is a cap 185 held in place by cap screws 186. The split support enables securing to shaft 37 by the support block both rotationally and longitudinally.

Each arm 36 is removably mounted on a shelf portion 188 as formed on the base block 184 with and by a cap screw 189 passing through a hole in said arm. A vacuum conduit 190 leads to a passageway 191 extending to the suction cup mounting at the outer end of arm 36. This passageway is, of course, closed at its outer end and at its mounted end is also closed or undrilled so that the passageway 191 carries suction action or force only from the vacuum conduit 190 to the cup 38. The cap screw 189 passes through an aperture formed in the arm portion 36 and into a threaded hole in the block 184. The number of arms and cups, as well as their position along shaft 37, is a matter of tray blank size. The cups are disposed to engage the rear flap or far edge portion 26 and after engagement the vacuum force is opened to the cups which engage and deliver the tray blank to the stop 40 and table 42 as in FIG. 1B.

Not shown, but contemplated, is the movement of roller chain 180 by a hydraulic cylinder. The stroke of the cylinder may be shortened or lengthened as needed. The control of this cylinder may also provide the timing control of the vacuum to the suction cups 38 since the suction (vacuum) is cut off as and after the tray blank has been drawn to the initial erecting condition as in FIG. 1B. The construction of these arms 36, so as to be shortened and lengthened, is also contemplated but the necessity of maintaining an absolute vacuum without leaks is very important so the cost of making and maintaining such arms with an adjustable capability and ready installation is a factor.

FRONT ERECTING APPARATUS OF FIGS. 16 AND 17

Figure 17:
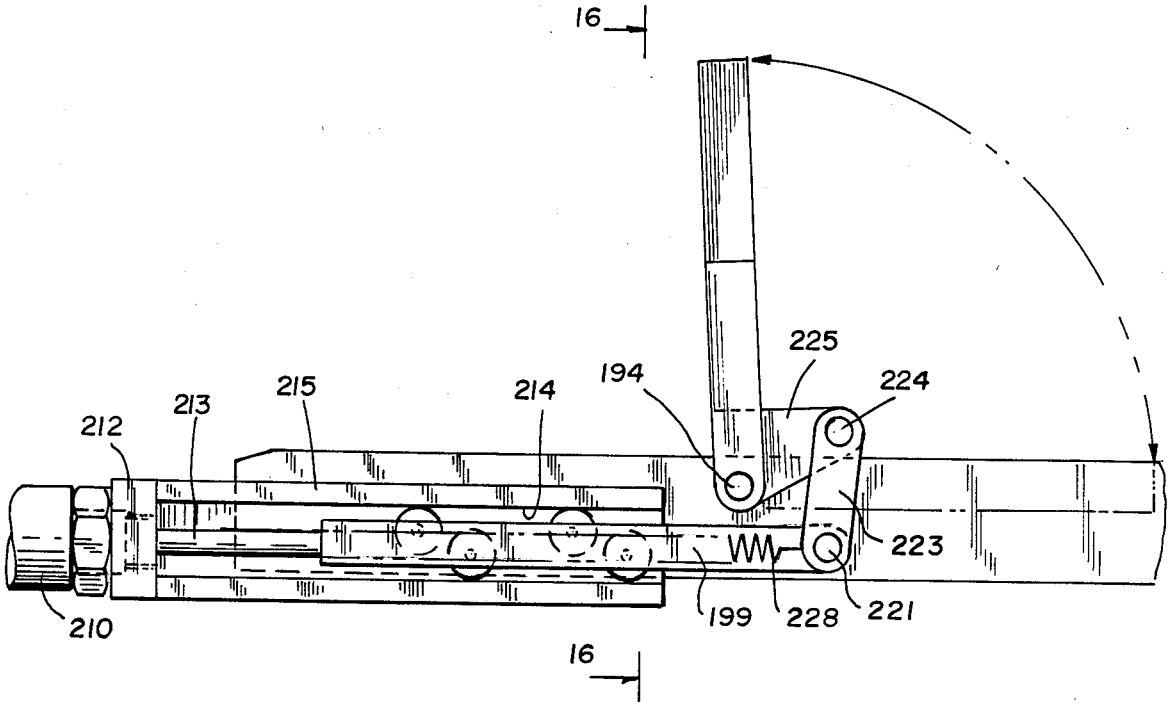
FIG. 17 represents a side view of the Y-finger apparatus of FIG. 16, this view partly diagrammatic and fragmentary, and showing more of the actuation apparatus.
Figure 16:
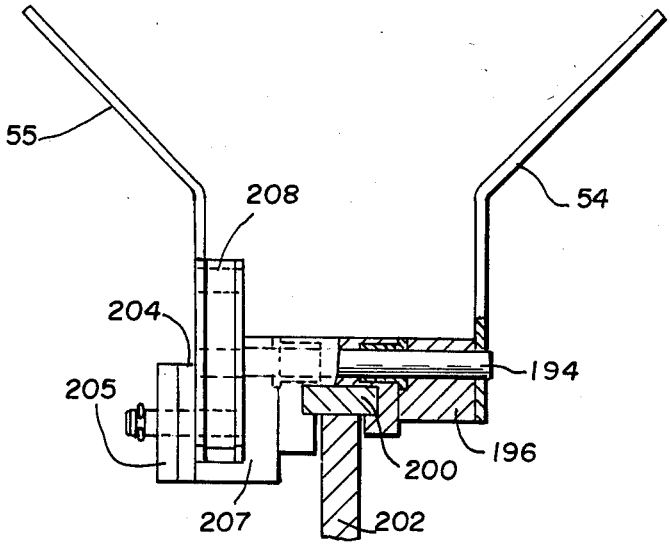
FIG. 16 represents a transverse view, partly in section, and showing diagrammatically and fragmentarily the Y-finger apparatus and typical actuation means.

In FIGS. 16 and 17 is depicted the front erecting apparatus in which the left and right Y-finger portions 54 and 55 shown in FIG. 1E are carried on a pivoted shaft 194 which is supported on its right end (FIG. 16) by a block 196. This block carries the Y-finger portion 54. Sleeve bearings 198 are carried in a guide block portion 199 which is slideable on a central support portion of the frame. As illustrated, said support is T-shaped with a transverse bar portion 200 above a rib or plate 202. Side guide portions 204 and 205 provide the side guide and retention means. It is to be noted that the left guide member is of greater depth for the mounting thereto of support members 207 and 208.

In FIG. 17 is shown the apparatus for moving and rotating the Y-fingers 54 and 55. A cylinder 210 (usually pneumatic) is carried in a fixed transverse header member 212. The piston rod 213 moves the slide guide block 199 forwardly and backwardly in response to an actuation signal not shown. The length of stroke is a matter of selection to accommodate the tray size. Suggested in this showing are roller means which are adjusted and secured to accommodate the width of slot 214 provided in fixed guide member 215. Suggested are rollers 216, 217, 218 and 219 (phantom outline) which, conventionally, are cam followers of the anti-friction type. Similar cam follower rollers are disposed in a slide guide block 220 on the near side.

The forward or right end of guided block 199 carries a pivot pin 221 on which is also mounted one end of a link 223. The other end of this link is pivotally connected by pin 224 to one end of a pivot link 225. This link is fixed to shaft 194 which has both ends rotatably carried in movable members as controlled by the cylinder 210. Rearward and forward return of the linkage to bring the Y-finger portions 54 and 55 to a flat or forward position is by a tension spring 228 which is attached at its forward end to pin 221 and at its rear end to a fixed guide member 215.

USE AND OPERATION

The Y-finger apparatus and the portions 54 and 55 are contemplated as being carried on shaft 194 and are moved to and from the vertical when this shaft is rotated. The Y-fingers are moved in and out along the shaft 194 by loosening and tightening securing means, this adjustment accommodating the width of the tray. The upward extent of the fingers is also conformed to provide effective stops for the front of the tray as erected at FIG. 1E. The Y-fingers 54 and 55 may require different sizes and configurations to accommodate tray size change, but the actuating apparatus is as shown in FIG. 17. Cylinder 210 is brought below the tray to permit the tray to be advanced forwardly. When the cylinder 210 is actuated to bring rod 213 to the condition of FIG. 17, the fingers 54 and 55 are in the vertical condition, whereas when rod 213 is moved rearwardly the spring 228 brings the fingers to a flat out-of-the-way condition. FIG. 16 shows the center support identified as 202, but this center member may be 133, as in FIG. 10, and 172, as in FIG. 13. No matter the number of plates, it is contemplated that the apparatus of FIGS. 16 and 17 will be associated with the center member.

FLAP TUCK APPARATUS OF FIGS. 18A THROUGH E

Figure 18B:
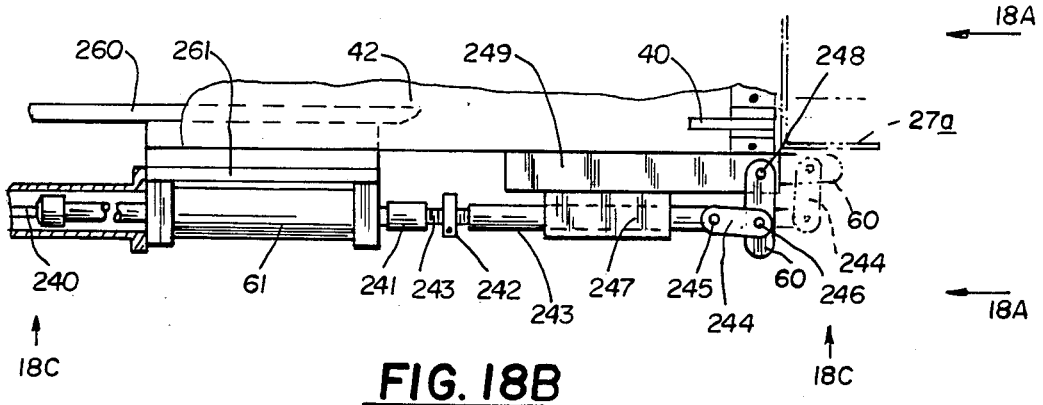
FIGS. 18B and C represent a diagrammatic top or plan view and also a side view of one embodiment of pivoted flap tucking apparatus, and using a cylinder connected to the pivoted flap tucking fingers.
Figure 18C:
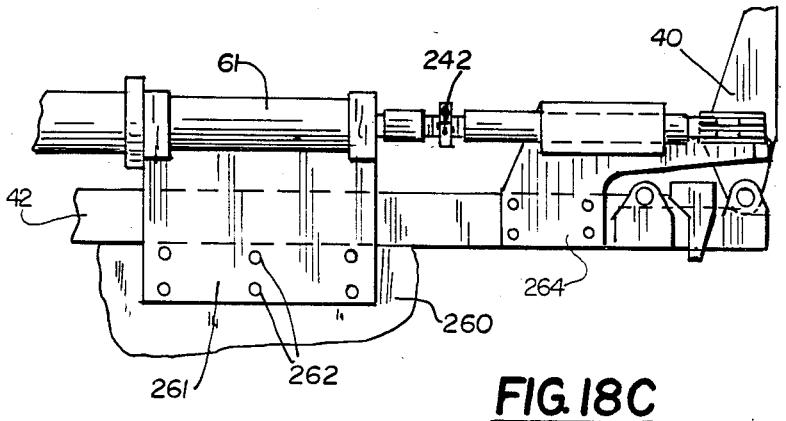
FIG. 18A represents a diagrammatic and partly sectional view of the arrangement of components providing the rear flap tucking means as carried on each of the outer adjustable side plate members.
FIGS. 18D and E represent a diagrammatic top or plan view and also a side view of an alternate embodiment of the pivoted flap tucking apparatus, using a cylinder that is not connected to the pivoted flap tucking apparatus but actuates said apparatus.
Figure 18A:
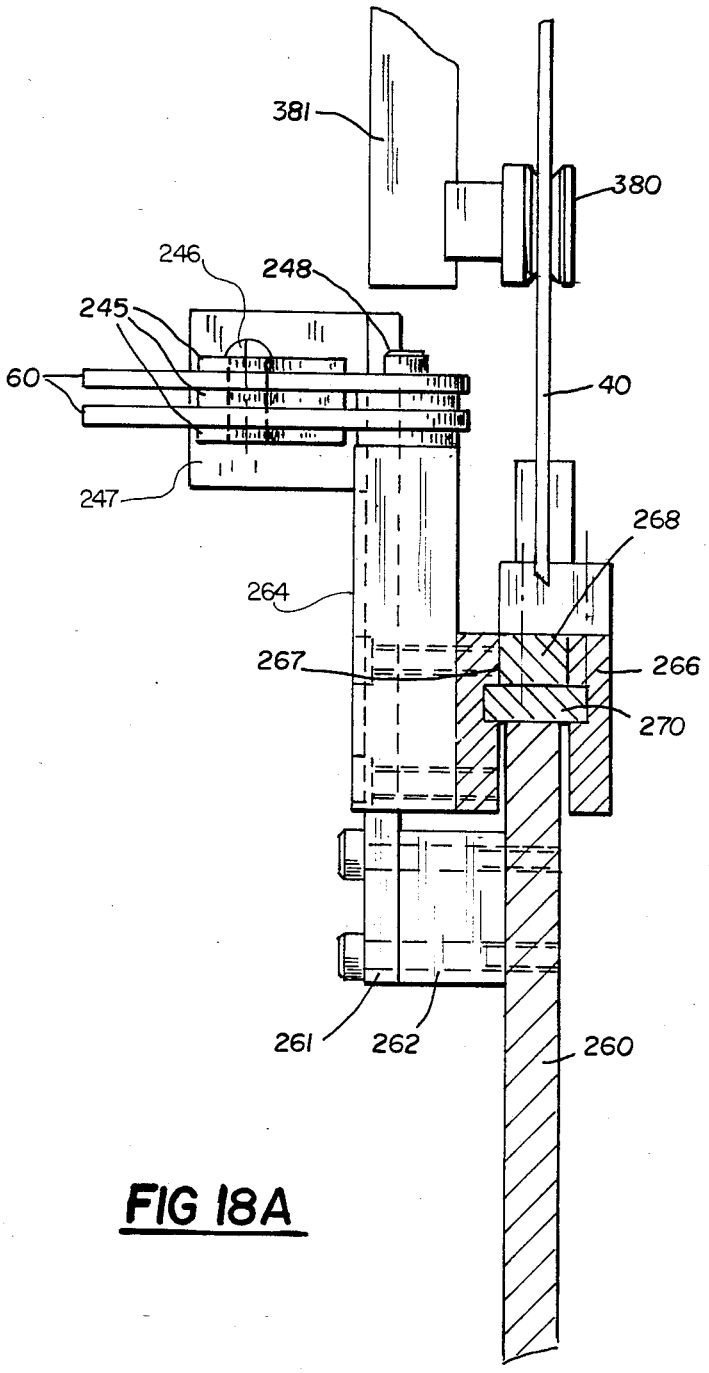

Referring next to the flap tuck apparatus of FIGS. A through E, it is to be noted that two modes of operation of the tuck apparatus are depicted. In one (FIGS. 18A, B and C), FIG. 18A depicts a diagrammatic cross-sectional view showing the arrangement of the reciprocable table and components providing the rear flap turning apparatus and, more particularly, for flap **27*a*, as diagrammatically shown in FIG. 1F. In the embodiment of FIGS. 18B and 18C, cylinder 61 is provided with a double-ended shaft 240 wherein the rear portion provides a speed control (not shown). This cylinder 61 is actuated and cycled forwardly and backwardly by a signal device (also not shown). This signal is precisely determined to provide removal, transfer and forward movement of the tray blank and erected tray. A rod or shaft 240 within cylinder 61 is cycled both forward and back. For convenience of construction and repair of the cylinder, the forward end of shaft 240 is provided for attachment to a coupling 241. An adjustable stop 242 is carried on a threaded portion of a forward shaft 243. The distal end of shaft 243 is configured to accommodate pivotally retained links 244 (usually two in number). A pivot pin 245 secures one end of the links 244 and a like pivot pin 246 is connected to and actuates link member 60**.

A movable block or retainer 247 is slideably retained on the reciprocating table 40. A hinge pin 248 retains the other end of links 60, allowing said link members 60 to be swung or rotated from the shown position to a ninety-degree position for turning a rear flap portion (**27*a* shown) indicated in phantom outline. This table 42 has an attached block 249 carrying pin 248 and which provides a toggle action of member 244. Block 242 is movable in relation to the table 40 and the forward movement is actuated by stop 242 when it engages the rear of the block 247. Friction means is contemplated and provided so that unwanted movement of block 247** and/or shaft 243 is not developed by and with excessive play.

In FIG. 18C, the side view of the flap turning apparatus of FIG. 18B shows that cylinder 61 is secured to an outer plate of the assembly. This outer plate is movable in and out, as noted in FIG. 18A and also as described in conjunction with FIGS. 10 through 13. Regardless of the number of support plates, the flap turning apparatus is secured to an outer plate. Although noted as 131, 135, 175 or 176 for the purposes of specific identification, this outer plate of FIG. 18A is identified as 260, and a support plate 261 is secured thereto by cap screws 262 or the like. This support plate carries the cylinder 61 in a fixed "front" to "back38 condition and is movable in and out with plate 260. Forwardly of support plate 261 is another support member 264 which is secured to the reciprocable table 42. There are two tables 42, with each carried on and reciprocably moved on an outer plate 260.

As seen in FIG. 18A, each reciprocable table includes inner and outer channel retaining members 226 and 267, with a precision slide and spacer 268 therebetween. This assembly of members 266, 267 and 268 is disposed to be slideably guided and retained by a bar 270 which is secured to the outer plate 260. This reciprocable table assembly is contemplated to be arranged as both right- and left-hand tables, with the fingers 60 and block 247 outward of the stops 40. Although the table 42 extends rearwardly of the stops 40 about sixteen to eighteen inches, the forward extension of the table ahead of the stops 40 is usually about six to seven inches so as to accommodate small trays.

In FIG. 18A there are shown two pivoted fingers 60, but there may be more or fewer as desired and, correspondingly, there usually are one or more pivoted associated links 244, with a pivot pin 246 maintaining these portions in a desired relationship. The distal end of shaft or rod 243 is contoured to accept the left ends of links 244. The retained ends of fingers 60 are pivotally swung around pivot pin 248 secured to block 264 which is movable with table 42. This support 264 is sized as to thickness so that movable block 247 is in the desired alignment.

EMBODIMENT OF FIGS. 18D AND 18E

Figure 18D:
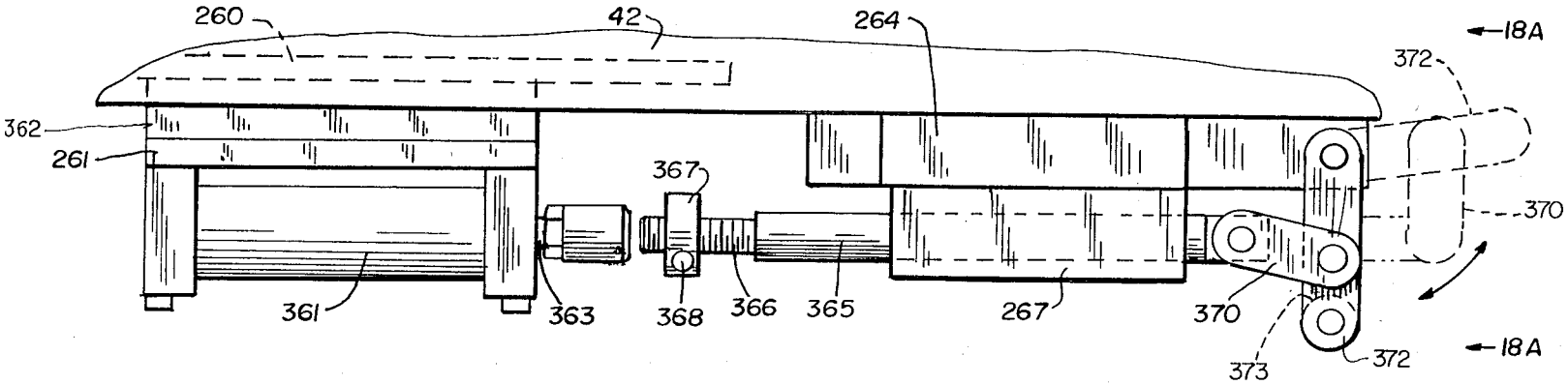

The end view of FIG. 18A is also typical of the embodiment of FIGS. 18D and E. In this embodiment, the cylinder actuating the toggle mechanism is not connected to an actuating rod. A cylinder 361 is carried by and attached to an outer plate 260. A spacer block 362 is used to carry plate support 261 as described above. The cylinder 361 has a single rod with an end 363 on which is mounted and secured a striking end member 364. This striking end member is usually made with an end of a slightly resilient material such as Teflon (TM DuPont). An actuating rod 365 has its left end with a threaded portion 366 on which is adjustably carried collar stop 367. This collar stop is depicted as split and, by and with a screw 368, is tightened in the desired position so as to be retained in this position.

Figure 18E:
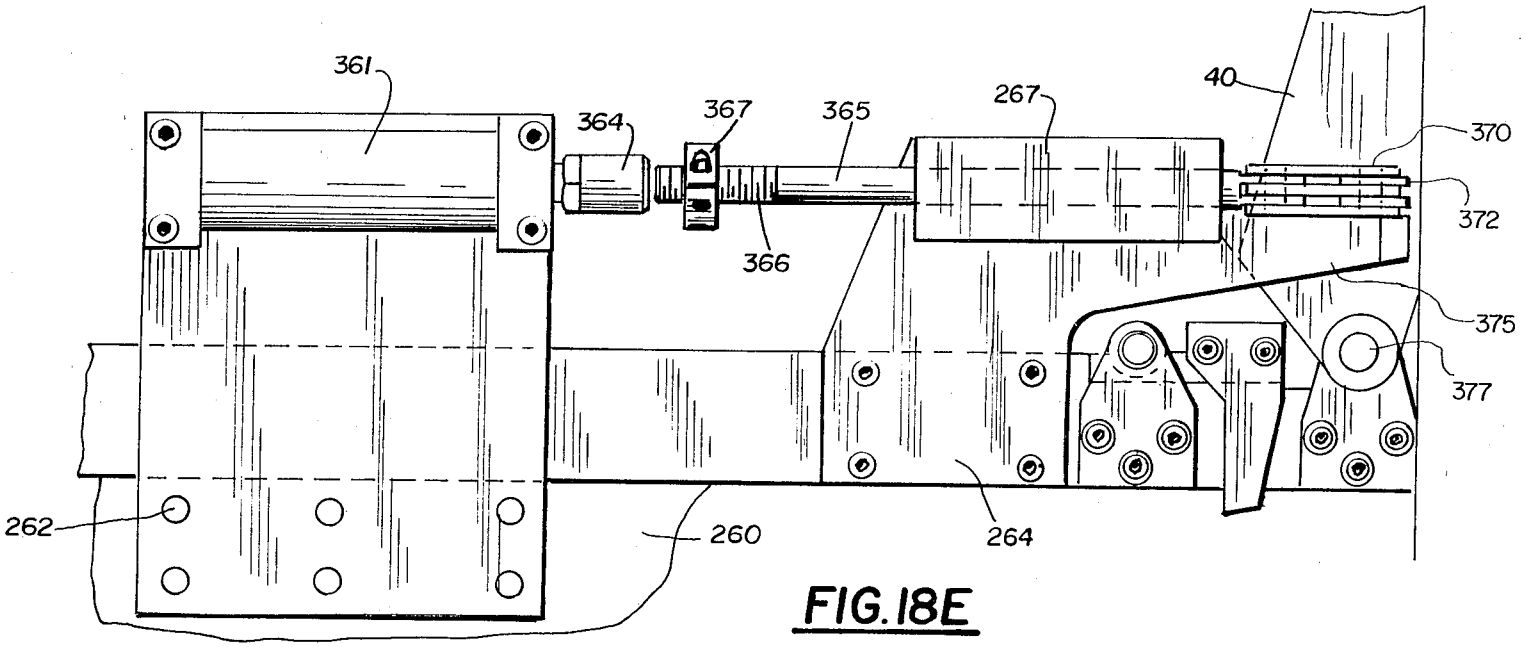

The forward movement of actuating rod 365 causes the collar stop 367 to engage the left end of a carrier support 267 and carry it forwardly in relation to the support 264 secured to and movable with table 42. As seen in FIGS. 18D and 18E, the linkage is slightly different than in FIGS. 18B and 18C in that the throw actuation is greater than ninety degrees. Pivoted links 370 engage fingers 372 at a slightly outward angle from the center line of actuating rod 365. The outer ends of finger 372 are disposed to retain rollers or spacers 373 and, in a swung condition, these fingers 372 are actuated slightly inwardly to move flaps **27*a* or 27*b*** to the desired flap tuck position.

In FIG. 18E there is depicted a cutout 375 for components diagrammatically shown as carried by and with the reciprocable table 42. Stop 40 is shown as pivoted and is swung around a pivot pin 377. Not shown and described is the apparatus for causing the stop 40 to be brought to a condition below the erected tray bottom. If the tray erecting apparatus is slowly actuated, the stops 40 may be fixed as long as these stops are returned to the starting condition before a new blank is drawn from storage. When and where the speed of the apparatus is increased, it is necessary to return the stops 40 to the start position when and while the tray is being further moved forwardly for completion. For this reason, the stops 40 are pivotally carried so as to be returned to their starting condition beneath a tray before the tray is completely forward. This pivot action enables a succeeding tray blank to be swung downwardly (as in FIG. 1B) while this stop 40 is being positioned to an upright condition. Seen in FIG. 18A is a roller stop 380 as carried by the frame of the apparatus 381, this stop limiting the swing extent of the stop 40.

In FIGS. 18B, C, D and E, it is to be noted that the pivoted finger assembly is carried in an associated slideable retainer and is provided with means to return to the non-engaging condition of FIGS. 18B and 18D. In the embodiment of FIGS. 18B and C, the cylinder 61 is connected to shaft 243. In FIGS. 18D and E, the cylinder 361 is not connected to the actuating rod 365, but in all arrangements it is necessary that the pivoted mechanism be returned to its non-engaging position before returning to its start position. In FIGS. 18B and C, this return force is provided by the connection of the cylinder 61 to shaft 243. In FIGS. 18D and E, a stop means is provided to cause the rearward movement of support 369 in relation to the table 42. The continued forward movement of table 42 is utilized to cause the disengagement of the finger mechanism from the new-erected rear flap and remove said finger mechanism. Spring means may also be used for return motion.

In the drawings of FIGS. 18B, 18C, 18D and 18E, the member 243 and actuating rod 365 are shown as a rod or shaft, but this is not a critical requirement as it has been found that a flat plate member may be used and a desired friction may be provided. This movable plate-like member may have a slot formed therein and stop pin means provided in said slot for limiting the forward travel of the pivoted mechanism, and also with this stop to provide a return of the pivoted mechanism to its initial start position and condition. The stop 242 or stop 367 engage the left end of the movable housing 247 or carrier support 369 to cause it to move forwardly at the speed or rate as provided by the cylinder. The stroke of the cylinder limits the forward travel, which forward travel is made to suit the extent of the rear flap and extent of the tray.

The above-described tray erecting apparatus contemplates the use of a flat tray blank 20, with cutouts **22*a*, *b* and *c* establishing the end flaps 27*a* and *b* and 29*a* and *b*. The securing of these end flaps to side flap portions 30 and 31 as by adhesive does not preclude the use of other means such as staples. The length of flaps 27*a* and *b* and 29*a* and *b* is merely a matter of choice and a rectangular shape as shown is conventional. Round containers 46** are depicted as they are commonly used containers, but other shapes and quantity may be provided for erecting a retaining tray. Particularly noted is the tray-packing of rectangular boxes in plural layers.

Although the Y-fingers 54 and 55 are shown as bent members and are carried on a shaft 194 and rotated with this shaft, this "Y" shape has been selected as inexpensive and adapted to engage a large area of the corrugated board of the tray blank without unduly distorting the blank. The Y-shape has been selected as very effective, but other shapes may be used and more than two fingers may be utilized if and when desired. The product is shown as round containers 46, but other shapes may be and are contemplated.

The above-described apparatus shows tray erecting apparatus with adjusting means to accommodate trays of various sizes and with depths that are made to suit the product to be placed in this tray. Trays may enclose as many as twenty-four or more containers, but usually no fewer than four. The tray blank is usually of corrugated cardboard with four cutouts and score or fold lines for the bending at pescribed positions. The tray erecting apparatus provides the adjustable capabilities of the apparatus and within determined limits, width, length and height are easily accommodated.

USE AND OPERATION

The flap tuck apparatus of FIGS. 18A through E utilizes toggle apparatus to turn inwardly the rear flaps of the tray during erection. The flap tucking apparatus not only positions the rear flap against the contents of the tray, but the apparatus proceeds forwardly until the outer flap is brought into retaining position. It is to be noted that the flap tucking apparatus of FIGS. 18A through E is disengaged by the time the glue strips 67 and 68 are applied.

EMBODIMENTS OF FIGS. 19A AND 19B

Figure 19B:
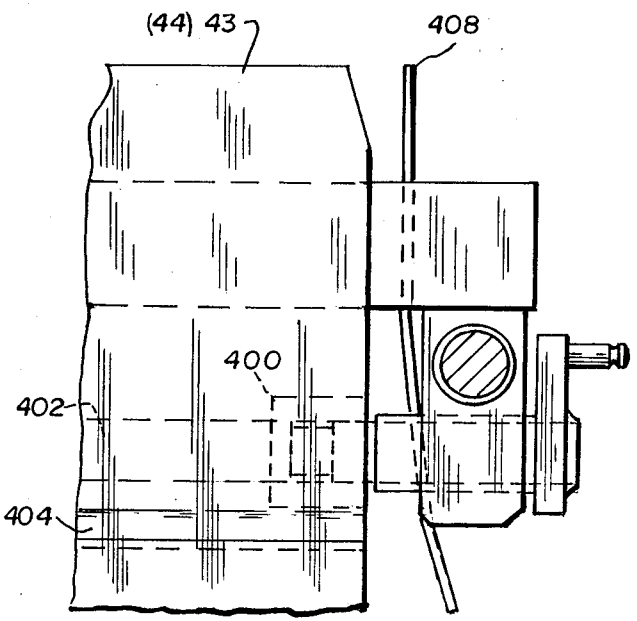
FIG. 19B represents a diagrammatic plan view showing not only a pivoted bridge plate, but pivoted side guide plates when the tray is to be filled with other than round containers.
Figure 19A:
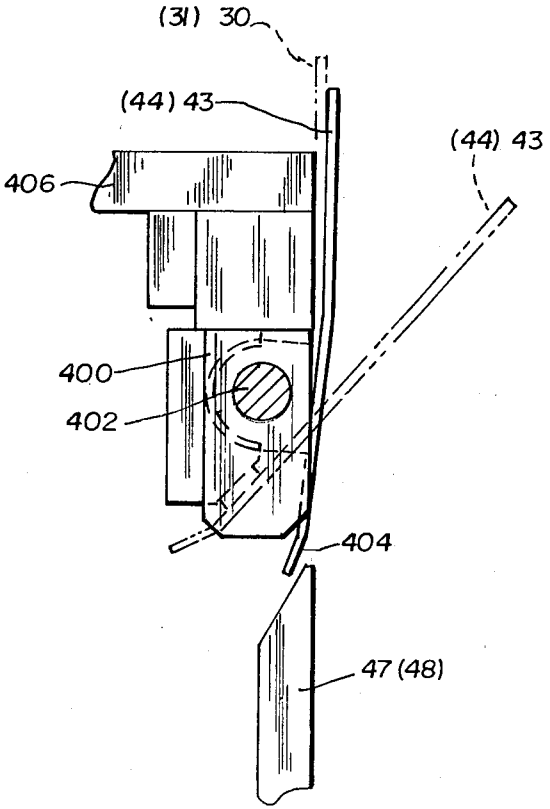
FIG. 19A represents a diagrammatic and fragmentary side view showing the pivoted bridge plate of FIGS. 1C, D and E, in an enlarged scale, the apparatus therewith.

Referring next, and finally, to FIGS. 19A and B, there is depicted the pivoted support plate 43 or 44, as seen particularly in FIG. 1D. In FIG. 19A, the support plate 43 is shown in two positions of use. This plate is carried by support blocks 400 on a pivoted shaft 402 actuated by mechanism not shown. The right or outer lip portion (identified as 404) is slightly bent so as to positively remain below a link member of a delivery conveyor 47 or 48. A stop member 406 is fixed to the frame and provides support for the advancing flap portion 30 or 31.

In FIG. 19B, the support plate 43 is fragmentarily shown and, if the tray is to be loaded with other than round metal containers, a side guide 408 is depicted. There is a like guide at the other end of support plate 43. Mechanism is provided so that these side guides are moved from in way of an advancing tray and any flap portions thereof.

As a method, the above-described apparatus provides novel steps of forming, filling and advancing an erected, filled and retained tray. The method providing for the receiving and transporting of tray blanks from an arrayed stack and with adjustable tray erecting and filling apparatus disposed to advance the filled trays to packaging operations includes the steps of:

(a) arranging a loading chute and carrying said chute on a frame and with said chute adapted to carry tray blanks as flat, sheet-like members in a side-by-side manner and in a forward sloped manner to deliver said tray blanks to a delivery hopper;

(b) delivering and supporting the tray blanks in said delivery hopper while providing a support means for the lower edge of each tray blank, and outer and opposite stop means for retaining the opposite or outer edge of said tray blank, the plurality of tray blanks disposed in the hopper at a slope of about thirty degrees to the horizontal;

(c) adjusting the width and length of the chute, hopper and stop means for the stacked tray blanks so as to accommodate a determined width and length of the tray blank;

(d) engaging and removing the lowermost tray blank in the hopper with and by a plurality of cups and applied vacuum to remove and move said lowermost tray blank to an erecting apparatus whereat and whereby said tray blank is brought to a position normal to the midportion of the tray blank;

(e) adjusting a pair of infeeding conveyors adapted to receive products to be placed in an erected tray, said products received in random order and subsequently arranged in a determined grouping;

(f) actuating a pair of adjustably-controlled pushers disposed to receive and position the products on the conveyors and to substantially and simultaneously advance the pushers sufficiently to urge and move the products to said midportion of the tray, the stroke of each of the pushers sufficient to urge and move the products suficiently so that the flaps of the tray may be brought to a position substantially normal to the midportion of the tray;

(g) providing at least two selectively positioned fingers carried by and secured to a rotatable shaft and disposed so as to engage the forwardly or near edge flap portion to an erected position normal to the midportion of the tray, the rotation of the shaft providing a corresponding moving of the fingers being in response to a signal indicating determined placement of the product on the midportion of the tray blank and moving the tray blank forwardly a determined distance whereat the fingers are moved from in way of the tray;

(h) arranging a pair of pivot finger members so that each member engages a rear side flap of the tray blank and actuating this pivoted apparatus so that each rear side flap is moved to a position substantially at right angles to the erected rear side edge portion, each of the pivoted finger members disposed adjacent a side of a reciprocated table on which the midportion of the tray blank is carried and with each pivoted finger member movable in a plane substantially parallel to the plane of travel of the reciprocated table;

(i) advancing the partially erected tray forwardly on said reciprocated table with said pivot-actuated finger mechanism and so that the end of the pivoted finger member engages the rear side flap of the tray to retain said erected flap in position during forward advancement to a selected limit of the advancing tray, after which the pivoted finger members are again rotated to a non-engaging flap erecting position during rearward movement of the table;

(j) positioning plow means in way of each forward side flap portion and, as the tray is advanced forwardly and to a selected position, the pivoted finger apparatus is retracted and said plow means causes the outer forward flaps to be folded inwardly and to a position substantially at right angles to the now-erected front edge of the tray, and (k) bringing the outermost side flaps against front and rear side flaps and securing the outermost side flaps and the front and rear side flaps as retaining end members of an erected tray.

Terms such as "left," "right," "up," "down," "bottom," "top," "front," "back," "in," "out," "clockwise," "counterclockwise" and the like are applicable to the embodiments shown and described in conjunction with the drawings. These terms are merely for the purposes of description and do not necessarily apply to the position in which the tray erecting apparatus and method with adjusting capability may be constructed or used.

While particular embodiments of the adjusting tray erecting apparatus have been shown and described, it is to be understood that the invention is not limited thereto and protection is sought to the broadest extent the prior art allows.

What is claimed is:

1. Apparatus for receiving and transporting tray blanks having a midportion for receiving articles and surrounded by front and rear flap edge portions, front and rear side flap portions and outermost side flaps from an arrayed stack and with an adjustable tray erecting and filling apparatus disposed to advance the filled trays to packaging operations, said adjustable tray erecting and filling apparatus including:

(a) a frame including a center plate and two outer plates, each outer plate movable toward and away from the center plate by adjusting means;

(b) a loading chute carried by said frame, said chute adapted to carry tray blanks as flat, sheet-like members in a side-by-side manner and in a forward sloped manner to a delivery hopper;

(c) means for delivering and supporting the tray blanks in said delivery hopper while providing support means for the lower edge of each tray blank and outer stop means for retaining the opposite or outer edge of said tray blank, these tray blanks disposed in said hopper at a slope of about thirty degrees to the horizontal;

(d) means for adjusting the width and length of the chute, hopper and stop means for the sloped stack of tray blanks so as to accommodate a determined width and length of a tray blank;

(e) means for engaging and removing the lowermost tray blank in said hopper with and by a plurality of vacuum cups and selectively applying vacuum to move and remove said lowermost tray blank to an erecting apparatus whereat and whereby said tray blank is brought to a forwardly advancing reciprocable table, with a rear flap edge portion brought against stops on said table that fold said rear portion to a position normal to the midportion of the tray blank;

(f) a pair of infeeding conveyors positioned adjacent to the tray blank and adapted to receive contained products to be placed in an erected tray, said contained products received in random order and subsequently arranged in a determined grouping;

(g) a pair of adjustably controlled pushers disposed to receive and position the products on the conveyors and to substantially and simultaneously advance the pushers sufficiently to urge and move the products to said midportion of the tray, the stroke of each of the pushers sufficient to urge and move the contained products sufficiently so that the flaps of the tray may be brought to a position substantially normal to the midportion of the tray;

(h) a support member carried on the center plate, this support member having a rotatable shaft movable in response to signal means to a cylinder and the like;

(i) a selectively positioned plurality of fingers carried and secured to said rotatable fingers in the support member, the shaft disposed and pivoted so as to engage the forward or front edge flap portion of the tray blank and move said forward flap portion to an erected position normal to the midportion of the tray, means for moving the fingers in response to a signal indicating determined placement of the product on the midportion of the tray blank, and for moving the fingers below the tray when the tray has been moved forwardly a determined distance;

(j) a reciprocable table apparatus carried on at least one of the outer support plates, this table apparatus including and carrying said stop disposed so as to engage and cause the tray blank to be brought to the condition with the back edge of the tray brought to a position normal to the center of the tray blank;

(k) a pair of toggle actuated pivot finger mechanism carried by and pivotable relative the reciprocable table apparatus, each finger mechanism including a first member whose distal ends are pivotally connected to a like member of said mechansim, and after the contained products and to the reciprocable table, means for moving said like member forwardly ater folding the front edge flap by said pivoting fingers at a speed in excess of the speed of the table to pivot said first member about its connection to the table to engage a rear side flap portion and move said portion to a position substantially at right angles to the erected rear side edge portion, each of the pivoted finger members disposed adjacent a side of said reciprocated table on which the midportion of the tray blank is carried and with each pivoted finger movable in a plane substantially parallel to the plane of travel of the reciprocated table, and after the toggle actuation has caused the rear flap to be moved to the desired position the finger mechanism is moved forwardly at the speed of the table;

(l) means for advancing the reciprocable table to move the partially erected tray while the first member engages the rear side flap of a tray to retain said erected flap in position during forward advancement of the tray to a selected limit, after which the pivoted finger mechanism is again rotated to a non-engaging flap erecting position during rearward movement of the table;

(m) plow means disposed to engage each forward side flap portion, and as the tray is advanced forwardly and to a selected position the pivoted actuated apparatus is retracted and said plow means causes the outer forward flaps to be folded inwardly and to a position substantially at right angles to the now-erected forward edge of the tray, and (n) means for bringing the outermost side flaps against the front and rear side flaps and securing the outermost side flaps and the front and rear side flaps into retaining end members of an erected tray.

2. Adjustable apparatus for erecting trays, as in claim 1, in which the means for securing the outermost flaps and rear and front flaps is an adhesive-applying means disposed to apply a given quantity of adhesive to the rear and front side flaps and means for bringing the outer side flaps to and against the adhesive and the inturned rear and front side flaps to secure these side portions in an erected tray configuration.

3. Adjustable apparatus for erecting trays, as in claim 2, in which the adhesive-applying means further includes means for bringing a pusher against the outside of each outermost flap with sufficient pressure and duration so as to effect a set of the adhesive.

4. Adjustable apparatus for erecting trays, as in claim 3, in which the adhesive is a hot-melt glue and is applied in controlled strips with timing apparatus.

5. Adjustable apparatus for erecting trays, as in claim 4, in which the pushers are pneumatically actuated in response to a signal and move inwardly for a determined distance and engage substantially the entire outer flap length during the set duration period.

6. Adjustable apparatus for erecting trays, as in claim 1, in which the vacuum cups which engage the lowermost tray blank are each carried on arms having conducting means for connecting the vacuum cup to a source of vacuum, said arms secured to a rotatable shaft moved in response to a pneumatic cylinder.

7. Adjustable apparatus for erecting trays, as in claim 6, in which the shaft carrying the arms is rotatably swung in a fixed path around a fixed axis and for less than one hundred eighty degrees, said rotational movement of the shaft being in response to timed signals as established for the actuation of the erecting apparatus.

8. Adjustable apparatus for erecting trays, as in claim 1, in which the adjustably-sized delivery chute, having a head end and a hopper for retaining the tray blanks, further includes upper and lower rack members carried with and by the sides of the chute, and at the head end of the chute and hopper are outer support block members, each outer support block member carrying a pair of spur gears in mesh with each other and with one of said gears also in mesh with one rack and with the other meshed spur gear in mesh with the second rack on this same side, these spur gears carried on shafts, at least one shaft extending to and into an outer support block member on the opposite side and attached to one of and simultaneously driving a like pair of spur gears which are in driving mesh with each other and with said gears engaging rack members carried on the far side of the chute and hopper.

9. Adjustable apparatus for erecting trays, as in claim 1, in which the adjustably-sized delivery chute for retaining the tray blanks further includes a lower rack member carried with and by the sides of the chute and on the head end of the chute are carried upper stops on block members, each block of which carries a spur gear in mesh with the lower rack, these spur gears carried on a shaft which extends to and into the other block on the other side, with a like pinion in driving mesh with the other lower rack member carried on the far side of the chute.

10. Adjustable apparatus for erecting trays, as in claim 1, in which a multiplicity of small, like-sized containers such as quarts, pints and the like are fed randomly on and along an infeed conveyor whereon they are accumulated and aligned in determined rows by guides, and with and after an accumulation of a selected number and a determined array a signal is generated whereby said pusher, contoured to nest the outermost engaged containers, engages and pushes this grouping into the partially erected tray.

11. Adjustable apparatus for erecting trays, as in claim 1, in which the adjustable fingers are arranged as a pair secured on and to a rotatable rod and with these fingers moved by a pneumatic cylinder to a position at which the forward flap is brought to an erected position, and at a determined period of time the cylinder is retracted and by a spring the fingers are brought to a position below the central portion of the tray blank.

12. Adjustable apparatus for erecting trays, as in claim 11, in which the fingers are a pair and as a pair are disposed in and with a Y-shape.

13. Adjustable apparatus for erecting trays, as in claim 11, in which the cylinder has a rod which is connected to and moves a guide block member carried by a plurality of rollers to provide a low friction movement of said member in a slot in a fixed member.

14. Adjustable apparatus for erecting trays, as in claim 1, wherein said like member is pivotally connected to an intermediate portion of said first member, and with an outer extending portion of said first member, when actuated, movable in an arc so as to engage and move the rear flap portion toward and to the erected tray.

15. Adjustable apparatus for erecting trays, as in claim 14, in which the pivoted mechanism is actuated by pneumatic cylinder whose movable shaft or rod is connected to a shaft member within the movable member and the distal end of said shaft is pivotally connected to the first member.

16. Adjustable apparatus for erecting trays, as in claim 14, in which the pivoted mechanism is actuated by a pneumatic cylinder whose movable shaft or rod is spaced from and not connected to a shaft member within the movable member and said shaft member is pivotally connected to the first member.

17. Adjustable apparatus for erecting trays, as in claim 14, in which said reciprocable table apparatus includes two table portions, each portion carried on an outer plate and each moved in and out as the associated outer plate is adjustably moved to accommodate the width of a tray and with each table moved by a pneumatic cylinder.

18. Adjustable apparatus for erecting trays, as in claim 17, in which each reciprocable table includes a stop which is pivotally mounted on said table and is moved to an upstanding condition and position while the lowermost tray blank is brought from the delivery hopper, and as and while the table is being returned to its start condition said stop is rotated to a substantially horizontal position so as to pass under a succeeding tray blank brought from the deliverly chute.

19. Adjustable apparatus for erecting trays, as in claim 18, in which each reciprocable table carries the toggle-actuated finger mechanism, and the member which actuates said toggle mechanism includes a slideable block carried by the table and accelerated speed of said block is achieved by a pneumatic cylinder which moves an adjustable stop collar into engagement with an end of said slideable block.

* * * * *